US005491941A

United States Patent [19]

Lancelot, III

[11] Patent Number: 5,491,941

[45] Date of Patent: Feb. 20, 1996

[54] SLIPPAGE CONTROLLED THREADED REBAR JOINT IN REINFORCED CONCRETE

[75] Inventor: Harry B. Lancelot, III, Hurst, Tex.

[73] Assignee: Richmond Screw Anchor Company, Fort Worth, Tex.

[21] Appl. No.: 314,076

[22] Filed: Sep. 28, 1994

[51] Int. Cl.[6] ..... E04C 5/08

[52] U.S. Cl. ..... 52/223.9; 52/223.1; 52/223.11; 52/233.14; 52/600

[58] Field of Search ..... 52/223.1, 223.9, 52/223.11, 223.14, 600; 411/259, 924, 929; 285/390; 403/343, 307, 299, 342

[56] References Cited

U.S. PATENT DOCUMENTS

| | | | |
|---|---|---|---|
| Re. 23,074 | 1/1949 | Henderson | 52/600 X |
| 2,210,553 | 8/1940 | Miller | 52/223.1 X |
| 2,917,901 | 12/1959 | Lackner | 52/223.1 X |
| 3,232,638 | 2/1966 | Hollander | 285/390 X |
| 3,295,286 | 1/1967 | Schaich | 52/600 X |
| 3,440,922 | 4/1969 | Cohen | 411/924 X |
| 4,179,142 | 12/1979 | Schopp | 285/390 X |

FOREIGN PATENT DOCUMENTS

| | | | |
|---|---|---|---|
| 1252875 | 10/1967 | Germany | 52/223.9 |

*Primary Examiner*—Carl D. Friedman
*Assistant Examiner*—W. Glenn Edwards
*Attorney, Agent, or Firm*—Beehler & Pavitt

[57] ABSTRACT

A rebar splice joint embedded in a reinforced concrete structure and having improved seismic resistance is made between a first rebar with an internal thread and a second rebar element having a male thread between a stop shoulder and the end of the rebar. The bar length between the stop shoulder and the male threaded bar end is shorter than the length of the internal thread. The male thread is turned into the internal thread and the first rebar is torqued against the stop shoulder to near the elastic limit of the bars to elastically deform the male and female threads into more uniform contact along their opposing thread surfaces thereby increasing contact area between the threads to reduce or eliminate relative axial movement between the rebars under cyclic axial loading, such as seismic loading.

17 Claims, 2 Drawing Sheets

SLIPPAGE CONTROLLED THREADED REBAR JOINT IN REINFORCED CONCRETE

BACKGROUND OF THE INVENTION

1. Field of the Invention

This invention pertains to the field of reinforced concrete construction and more specifically concerns improved splice joints between male and female threaded ends of steel reinforcement bars used in such construction.

2. Background of the Invention

In reinforced concrete construction it is commonly necessary to splice together steel reinforcement bars to meet the need for bar lengths longer than available stock, or to tie together adjacent sections of poured concrete. Such rebar splices are frequently made by providing mating threads at the rebar ends to be joined. One rebar end has a male screw threading, and a second rebar end is enlarged to form a socket with a female thread. A threaded splice can also be made by joining two male threaded rebar ends by means of an internally threaded sleeve. Threaded joints of this type include those with parallel threads, i.e. where the thread diameter is constant along its length, and tapered threads which diminish in diameter towards the end of the rebar in the case of male threading and where the female thread has a maximum diameter at the opening of the socket and diminishes in diameter towards its interior.

Tapered threads quickly separate as soon as they are loosened and the joint depends on tight frictional engagement between the male and female thread surfaces to preserve integrity of the rebar splice. Consequently, tapered threads require that the splice joint be torqued together in order to maintain the joint.

Parallel threads are not subject to this limitation, however, and the male/female threads remain in mutual engagement without being torqued together. Separation of the male/female threads requires that the male thread be actually fully unscrewed from the female thread, which does not occur simply as a result of loose engagement between the thread surfaces. This is reflected in the building codes presently in effect which do not require torquing of parallel thread rebar joints, and present industry practice in fact does not call for such torquing. Typically, the male thread is simply turned until the end of the rebar reaches the bottom of the female bore, a condition which under present practice is deemed to constitute a sufficient and adequate splice joint.

Rebar threads are cut or rolled into the steel bars to relatively low tolerances, due to the nature of the steel alloys used for manufacture of concrete reinforcement bars and the limitations of efficient high volume production of rebars at competitive cost. The result is that typical rebar thread surfaces have a significant degree of small-scale irregularity which at a micro level prevents full surface-to-surface contact between opposing male/female thread surfaces. These small scale irregularities do not normally reduce the tensile strength of the rebar splice joint, and current practice produces threaded joints which readily meet, for instance, building code requirements of a 60,000 psi yield strength and 90,000 psi ultimate tensile strength.

An aspect of threaded splice joints which has been largely overlooked until recently is the behavior of the splice joint under seismic or fatigue conditions where the joint is subjected to rapidly alternating tension and compression force cycles, i.e. where the load on the joint is rapidly and repeatedly reversed. Under such conditions, the spliced rebars do not perform as a single unbroken bar. For example, irregular contact between opposing thread surfaces in a parallel thread splice joint may be evidenced by clicking sounds as the joint is alternately subjected to stress and strain. If such a splice joint is embedded in a concrete structure, one or both of the rebars may slip axially relative to the surrounding mass of concrete when subjected to cyclic loading along the splice axis. Any movement of a rebar relative to the concrete it is intended to reinforce is undesirable and potentially weakens the structure.

Current building codes only specify that a rebar splice must exceed 125% of its yield strength under continuous load conditions without breaking. Rebar splices are not tested for slippage of the rebars relative to the concrete nor for splice joint performance under peak loads typical of seismic conditions.

What is needed is a threaded rebar splice joint which is more resistant to cyclic loading conditions, with performance more closely approximating that of an unbroken, continuous steel bar.

SUMMARY OF THE INVENTION

This invention addresses the aforementioned need by providing a method for making a seismic resistant splice between steel reinforcing bars in a concrete structure. A first rebar has an internal or female thread at a first rebar end. A second rebar has an exterior or male thread extending between a stop element and a second rebar end. The length of the male thread between the stop element and the second rebar end is shorter than the length of the internal thread on the first rebar end. The splice is made by threading the male thread into the internal thread, and then torquing the first rebar end against the stop element on the second rebar sufficiently to deform the male and female threads into substantially more uniform contact along opposing thread surfaces of the two rebar ends, thereby to increase the area of contact between the threads and thus to substantially reduce or eliminate movement of the rebars relative to each other under cyclic axial loading. At least portions of the first and second rebars including the spliced together first and second rebar ends are embedded in a concrete structure for reinforcing the concrete structure.

The stop element may be annular about the second rebar, such as a circumferential shoulder which preferably is integrally formed with the rebar and defines a stop surface facing the threaded end of the bar.

The torquing of the first rebar end against the stop preferably includes application of sufficient torque to achieve an axial loading of the rebar ends approximating but lesser than the characteristic yield strength of the rebars so that the deformation of the male and female threads remains elastic.

The resulting splice joint is characterized by a substantially increased area of contact between the male and female threads over the undeformed threads of the splice joint without torquing. As a result, axial loads on the splice joint are distributed more uniformly over the helical length of both male and female threads as opposed to a more irregular and spotty contact between the originally undeformed threads. The deformation of the mated threads in effect reduces or removes the original manufacturing tolerances of the rebar threads in the torqued splice and thus minimizes the freedom of movement between the joined rebar ends relative to each other and to the surrounding concrete under cyclic loading conditions.

The optimum torque to the splice joint is such as to axially preload the joined rebar ends to a load approximating but lesser than the characteristic yield strength of the rebar material so as to retain elasticity of the deformed male and female threads.

These and other features, improvements and advantages of this invention will be better understood by reference to the following detailed description of the preferred embodiment taken in conjunction with the accompanying drawings.

DETAILED DESCRIPTION OF THE PREFERRED EMBODIMENTS

Figure 1:
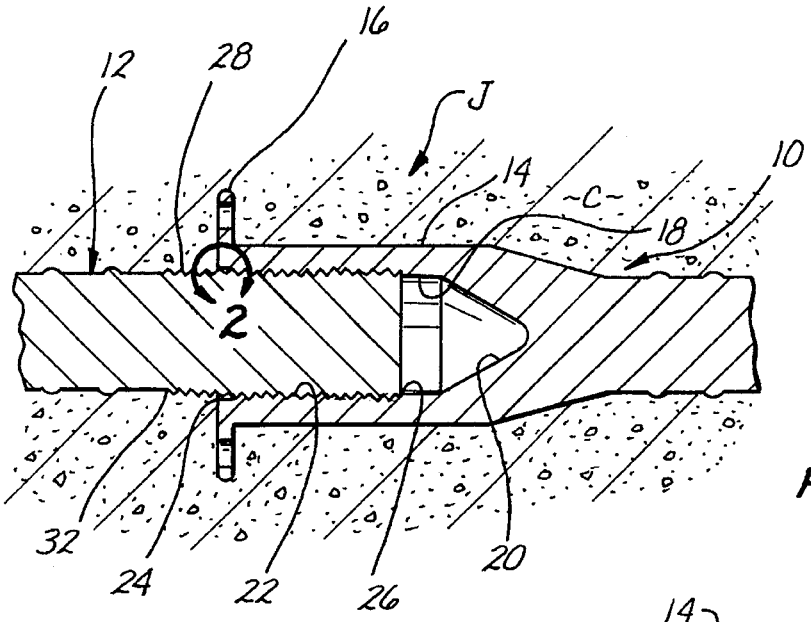
Fig. 1 PRIOR ART
FIG. 1 is an axial section of a threaded two-piece splice according to current practice.

FIG. 1 illustrates a splice joint J made according to current practice between a conventional dowel bar 10 and a conventional dowel-in 12. The dowel bar has an enlarged head 14 terminating in a flange 16. A bore 18 extends axially into the head 14 from the center of the flange 16 and terminates in a blind inner end 20, which in this example is concavely conical in shape. An internal or female thread 22 is cut in the bore 18 from the open end 24 of the bore to a thread end 26 which is spaced from the conical end surface 20 of the bore 18. The dowel-in 12 has an external or male thread 28 which extends from the end 30 of the dowel-in to a male thread end 32.

According to conventional practice, the dowel-in 12 and dowel bar 10 of FIG. 1 are spliced together by turning the male thread 28 into the bore 18 until the end 30 of the dowel-in reaches the thread end 26 of the interior thread 22. The splice joint is typically made by simply hand turning the dowel-in, although in construction projects where large numbers of splices need to be made at a given time, power tools such as a centrifugal chuck on an electric or air powered drill motor may be used to speed installation. In either case, no particular attention is given to torquing of the splice joint J other than to turn the dowel-in 12 until it is fully threaded into the dowel bar end 14.

Normal thread tolerances for steel reinforcing bar is class 2, specifically class 2A for the female thread, and class 2B for the male thread, which are the standard tolerances for nut and bolt combinations in the fastener industry. Class 2 tolerances permit a variation or delta of 0.001" in the mean thread diameter, measured halfway between the crest and valley of the thread.

Figure 2:
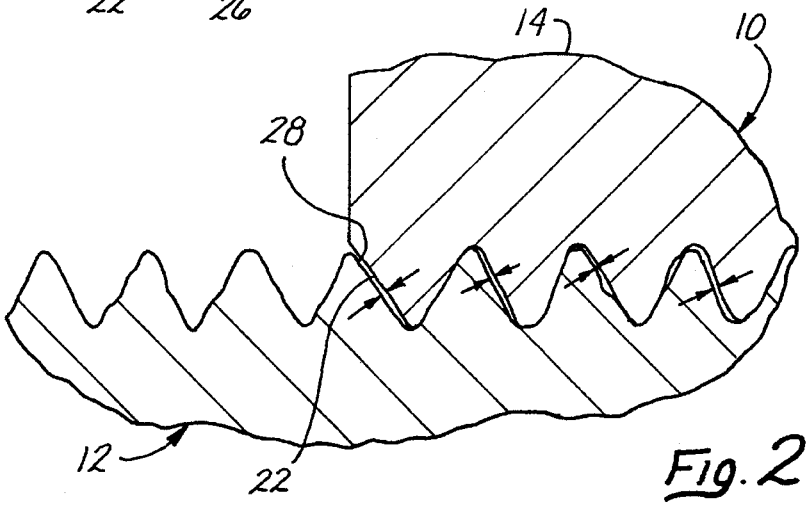
Fig. 2 PRIOR ART
FIG. 2 is an enlarged detail view of the area 2—2 in FIG. 1 illustrating the typically imperfect contact between opposing thread surfaces in the splice joint due to small scale irregularities and thread manufacturing tolerances.

This tolerance level coupled with relatively rough surface finish of the typical reinforcing bar stock threading results in uneven and discontinuous contact between the opposing male and female thread surfaces along the helical threads. FIG. 2 illustrates in magnified detail the cross section of the mated male/female threads of the prior art splice of FIG. 1. Contact between the opposing thread surfaces is imperfect due in part to the deviation of the threads from a true helical shape, and in part due to the small scale irregularities in the thread surfaces. The result is that a substantial portion of the male and female thread surfaces are in mutually facing relationship but spaced from each other to varying degrees without making contact with each other. The combined effect of these imperfections in the splice joint threading often permits a small degree of relative axial displacement between the two rebar elements when a sufficient axial load is applied to the spliced bars. This phenomenon is aggravated under conditions of cyclic loading where the splice joint is repeatedly and rapidly subjected to high peak axial loads. Under such circumstances, an audible clicking sound may be heard as the male thread alternately strikes against one side of the female thread groove and then against the other side due to the imperfect fit within the thread groove. When such a prior art rebar splice is embedded in a concrete structure and therein subjected to cyclic loading, the slight degree of axial freedom between the splice ends may lead to loss of cohesion between one or both of the rebar elements 10, 12 and the surrounding concrete mass C. Separation of the reinforcing bar from the concrete weakens the structure and if the condition becomes widespread among the reinforcing bars of a particular structure, may lead to catastrophic failure of the same.

Figure 3:
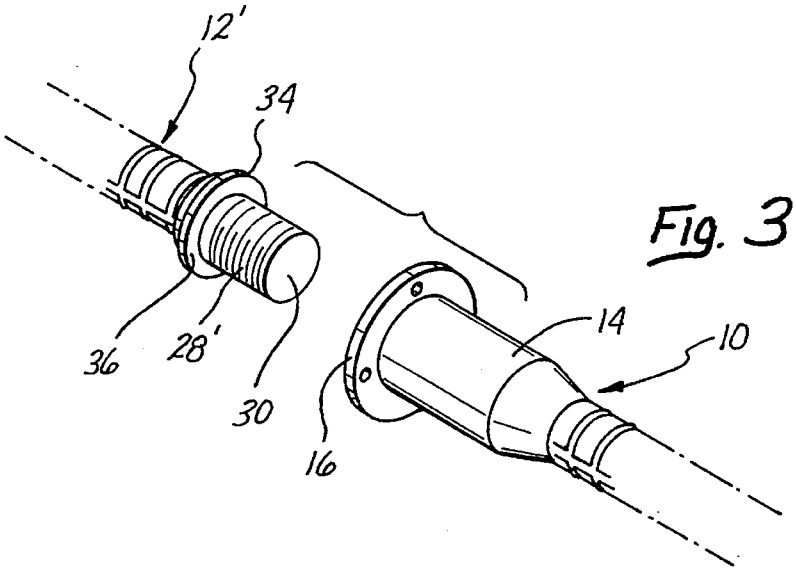
FIG. 3 is a perspective view showing a male threaded rebar end according to this invention in axial alignment with a female threaded rebar end prior to threading engagement one to the other for making a splice joint.

FIG. 3 illustrates a dowel-in 12' improved according to this invention and a dowel bar 10 which is similar to the dowel bar 10 of FIG. 1. The improved dowel-in 12' has an external thread 28 between a bar end 30 and an annular flange 34 which is formed integrally with the bar 12' and which provides an annular stop surface 36 facing the end 30 of the bar.

Figure 4:
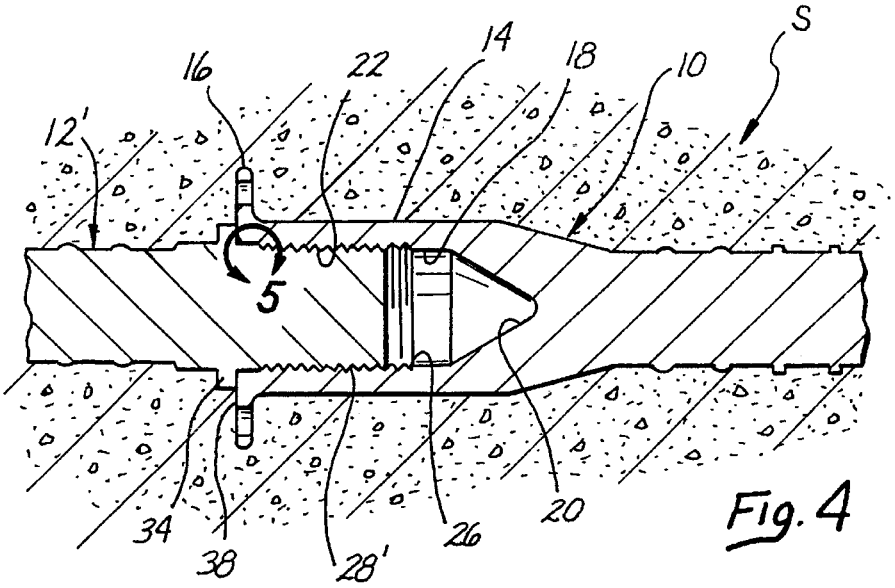
FIG. 4 is a longitudinal section of a splice joint made with the rebar ends of FIG. 3.

FIG. 4 shows an improved rebar splice joint S formed by threading the end of the improved dowel-in 12' into the conventional dowel bar 10. The male thread 28' of the dowel-in is mated to the female thread 22 of the dowel bar and advanced into the bore 18 until the stop surface 36 of the flange 34 comes against the face 38 of the flange 16, as better seen in FIG. 5. Contact between the stop face 36 and flange face 38 is annular over the entire stop surface 36, and is radially symmetrical with respect to the longitudinal axis of the splice joint S.

Figure 5:
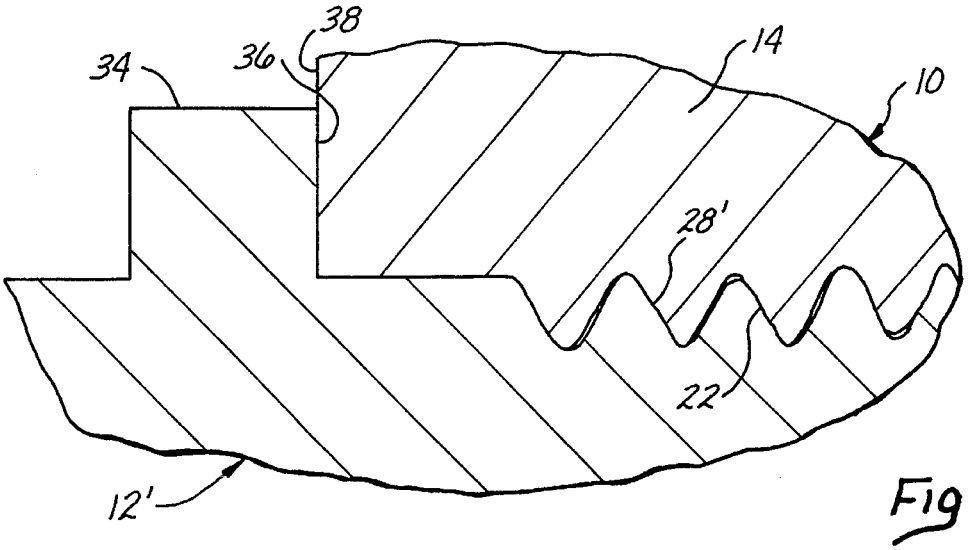
FIG. 5 is an enlarged detail view of area 5—5 in FIG. 4 showing the improved contact between opposing thread surfaces resulting from torquing of the splice joint and consequent deformation of the male and female threads.

An important feature of the improved dowel-in 12' is that the axial length of the male thread 28', measured between the end 30 and the stop surface 36, is shorter than the axial length of the female thread 22 measured between the flange face 38 and the inner thread end 26. This feature prevents the end of the male thread 28' from jamming into the end 26 of the female thread 22, as typically occurred in prior art splices such as illustrated in FIG. 1. Once contact is made by the stop surface 36 against the flange surface 38, the splice joint S of FIGS. 4 and 5 is completed by torquing the dowel-in 12' in relation to the dowel bar 10 with a force sufficient to deform the male and female threads, 28', 22 respectively, into substantially more uniform contact along the mated thread surfaces.

The annular flange 34 and stop surface 36 serve an important role in achieving uniform distribution of the torque force along the entire helical length of the male and female threads 28', 22 respectively. The symmetrical annular contact of the stop surface 36 against the face 38 of the flange 16 allows the tensile forces created by torquing of the two bar elements relative to each other to distribute themselves in a rather uniform manner along the threads.

Torquing of the splice joint strains the mated threads which are drawn tightly against each other and mutually correct towards a more perfectly helical shape. Also, the opposing thread surfaces may shift slightly or locally deform at a micro scale against each other to achieve a better meshing together of the small scale surface irregularities, further enhancing the extent of surface contact between the mated threads. The extent of deformation of the mutually engaged threads in the splice of FIG. 1 is directly related to the torque applied to the joint. The greater the torque, the greater the deformation of the threads into increased mutual contact along the thread surfaces. The condition of the engaged threads shifts from the imperfect, irregular mutual contact of FIG. 2, to a more uniform contact of the opposing thread surfaces illustrated in FIG. 5. A practical limit, however, is imposed by the characteristics of the rebar material, specifically the characteristic yield strength of the rebar elements 10, 12'. If the torque applied results in an axial loading of the engaged rebar ends beyond the characteristic yield strength of the material involved, the deformation of the threads becomes inelastic, at which point the threads deform permanently and may be damaged in a manner detrimental to the integrity of the splice joint. For a given pair of male/female threads, optimum deformation of the threads for maximizing the area of contact between the opposing thread surfaces is achieved by applying sufficient torque so as to reach an axial loading of the spliced rebar ends which approximates but is lesser than the characteristic yield strength of the rebar material. Mathematical expressions applicable to tightening of threaded fasteners, such as bolt and nut joints, are also applicable to the rebar splice joint of FIG. 4. In particular, the equation commonly referenced for relating assembly torque to the axial or clamp load of threaded fasteners is:

$$T=KDW$$

where

T is assembly torque measured in inch-pounds;

K is torque coefficient;

D is the nominal bolt diameter in inches; and

W is the target axial tension or clamp load.

For optimum performance of the splice joint S of FIGS. 4 and 5 under cyclic loading, the value of W should normally be set at slightly less than the characteristic yield strength of the particular rebars 12' and 10 being spliced.

K has been experimentally derived, and for mild steel of the type commonly used for concrete reinforcing bars is usually assumed to have a value of 0.20.

Based on this equation, approximate values of the torque necessary to achieve optimum splice joint performance under cyclic loading can be computed, and the splice joint S can be torqued to the computed value with the aid of suitable tools, such as calibrated torque wrenches, for example.

It should be appreciated that this result is quite different from that obtained by torquing a prior art splice such as shown in FIG. 1. In the prior art splice J, the end of the male thread 28 reaches the end 26 of the female thread 22 and is prevented from advancing beyond that point into the bore 18. As torque is applied to the dowel-in 12 relative to the dowel bar 10, the end of the male thread is jammed against the end of the female thread. The torque force is concentrated at this point, which is radially offset from the longitudinal axis of the splice, and sets-up a reactive force urging the dowel-in 12 diametrically away from the thread end 26 within the bore 18. The result is an asymmetrical distribution of the torque forces which tend to become localized near the end 30 of the dowel-in 12, and do not spread uniformly along the length of the mated male and female threads 28, 22. Deformation of the threads is generally limited to the vicinity of the end 30 and does not produce the superior results of the torqued splice S of FIGS. 4 and 5.

Figure 6:
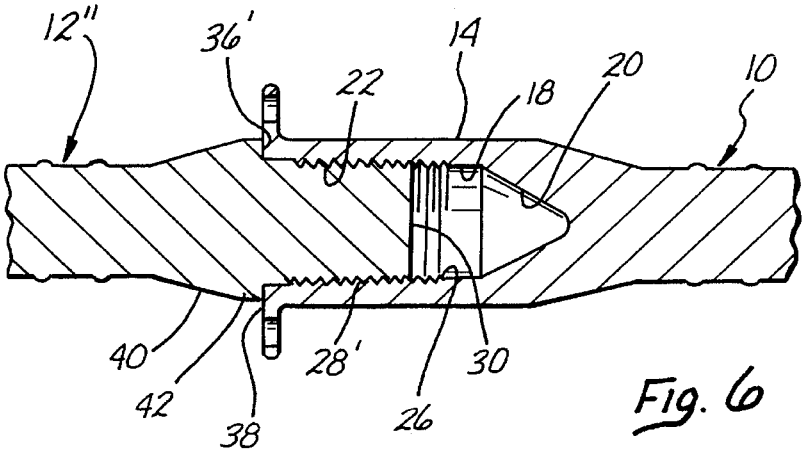
FIG. 6 is a longitudinal view of a splice joint featuring an alternate configuration of the annular shoulder on the male threaded bar end.

FIG. 6 shows an alternate dowel-in 12" where the annular stop surface 36' is provided by a flaring transition 40, with the bar 12" gradually increasing in diameter to form a shoulder 42 terminating in the stop surface 34, which functionally performs in the manner of the stop surface 34 described in connection with the dowel-in 12' in FIG. 4.

While particular embodiments of the invention have been described and illustrated for purposes of clarity and example, it must be understood that many changes, modifications and substitutions to the described embodiments will become apparent to persons having ordinary skill in the art without thereby departing from the scope and spirit of the present invention which is defined only by the following claims.

What is claimed is:

1. A method of making an end-to-end splice joint between two steel reinforcing bars in a concrete structure, said splice joint characterized by improved seismic resistance, comprising the steps of:

providing a first rebar element having an internal thread at a first rebar end;

providing a second rebar element having a male thread between a stop means and a second rebar end, said second rebar element being shorter between said stop means and said second rebar end than the length of said internal thread;

threading said male thread into said internal thread;

torquing said first rebar end against said stop means sufficiently to elastically deform said male and female threads into more uniform contact along opposing thread surfaces of said ends thereby to substantially increase the area of contact between said threads and thus reduce or eliminate axial movement of said rebars relative to each other under cyclic axial loading; and embedding at least parts of said first and second rebar elements including said first and second rebar ends in a concrete structure.

2. The method of claim 1 wherein said stop means is annular about said second rebar.

3. The method of claim 1 wherein said stop means comprises a circumferential shoulder on said second rebar.

4. The method of claim 1 wherein said stop means is integral with said second rebar.

5. The method of claim 1 wherein said stop means is a circumferential shoulder integral with said second rebar.

6. The method of claim 1 wherein one of said rebar elements is fixed in a concrete structure prior to said threading step.

7. The method of claim 1 wherein said torquing includes application of sufficient torque to achieve an axial loading of said rebar ends approximating but lesser than the characteristic yield strength of said rebar elements, thereby to maximize contact area between the mutually engaged male and female threads for a given first and second rebar elements.

8. A reinforced concrete structure having improved seismic resistance, comprising:

a concrete structure, first and second rebar elements embedded in said concrete structure, said first rebar element having an internal thread at a first rebar end, said second rebar element having a male thread between a stop means and a second rebar end, said second rebar element being shorter between said stop means and said second rebar end than the length of said internal thread, said male thread being threaded into said internal thread, said first rebar end being axially preloaded against said stop means with sufficient force to elastically deform said male and female threads from a normal undeformed condition into substantially more uniform contact along opposing thread surfaces of said ends thereby to reduce axial movement of said rebars relative to each other and said concrete structure under cyclic axial loading of said structure.

9. The structure of claim 8 wherein said stop means is annular about said second rebar.

10. The structure of claim 8 wherein said stop means is a circumferential shoulder on said second rebar.

11. The structure of claim 8 wherein said stop means is integral with said second rebar.

12. The structure of claim 8 wherein said stop means is a circumferential shoulder integral with said second rebar.

13. The structure of claim 8 wherein said first rebar element is axially pre-loaded against said stop element to a load near but lesser than the characteristic yield strength of said rebar element.

14. A splice joint made with first and second concrete reinforcing rods, one of said rods having an enlarged head at a first rod end, a blind axial bore in said head opening at an end surface of said first rod end, an internal thread in said bore, the other of said rods having a shoulder and an external thread between said shoulder and a second rod end, the axial length between said shoulder and said second rod end being shorter than the axial length of said internal thread, said exterior thread being threaded into said internal thread so that said end surface bears against said shoulder, said first and second concrete reinforcing rods being torqued together to develop an axial load of said internal and external thread near to but lesser than the characteristic yield strength of said rods.

15. The splice joint of claim 14 wherein said shoulder is annular about said second concrete reinforcing rod.

16. The splice joint of claim 14 wherein said shoulder is integral with said second concrete reinforcing rod.

17. The splice joint of claim 14, both said first and second concrete reinforcing rods being embedded in concrete.

* * * * *